US012723334B2

(12) United States Patent
Pacheco Gonçalves et al.

(10) Patent No.: US 12,723,334 B2
(45) Date of Patent: Sep. 1, 2026

(54) COMPRESSION ARTICLE WITH A PLATING YARN

(71) Applicant: SIGVARIS AG, St. Gallen (CH)

(72) Inventors: Rafael Sérgio Pacheco Gonçalves, Itupeva/SP (BR); José Fabiano Caboclo, Várzea Paulista/SP (BR)

(73) Assignee: SIGVARIS AG, St. Gallen (CH)

( * ) Notice: Subject to any disclaimer, the term of this patent is extended or adjusted under 35 U.S.C. 154(b) by 0 days.

(21) Appl. No.: 19/475,080

(22) PCT Filed: Apr. 12, 2023

(86) PCT No.: PCT/EP2023/059496

§ 371 (c)(1),
(2) Date: Oct. 14, 2025

(87) PCT Pub. No.: WO2024/213232

PCT Pub. Date: Oct. 17, 2024

(65) Prior Publication Data

US 2026/0234843 A1 Aug. 13, 2026

(51) Int. Cl.

| | |
|---|---|
| ***D04B 1/12*** | (2006.01) |
| ***D04B 1/18*** | (2006.01) |
| ***D04B 1/26*** | (2006.01) |

(52) U.S. Cl.

CPC ..... *D04B 1/123* (2013.01); *D04B 1/126* (2013.01); *D04B 1/18* (2013.01); *D04B 1/26* (2013.01)

(58) Field of Classification Search

CPC ..... D04B 1/123; D04B 1/10; D04B 1/102; D04B 1/18; D04B 1/126; D04B 1/26;

(Continued)

(56) References Cited

U.S. PATENT DOCUMENTS 627,945 A * 6/1899 Waterfield ..... D04B 1/18 66/190
1,872,760 A * 8/1932 Lawson ..... D04B 9/34 66/146

(Continued)

FOREIGN PATENT DOCUMENTS

AU 2023441996 A1 * 10/2025 ..... D04B 1/123
KR 20240119453 A * 8/2024 ..... D04B 9/42
WO 2009136063 A1 11/2009

OTHER PUBLICATIONS

International Search Report for PCT/EP2023/059496 mailed Nov. 23, 2023.

*Primary Examiner* — Danny Worrell

(74) *Attorney, Agent, or Firm* — Perilla Knox & Hildebrandt LLP; Thomas B. Hildebrandt

(57) ABSTRACT

The invention relates to a tubular weft-knitted jersey-based article having a portion of the size of at least four consecutive courses and at least four consecutive wales, wherein all of the at least four courses are plated courses. Each plated course comprises a ground yarn that entirely forms plain stitches, two or three laid-in yarns, a plating yarn. The laid-in yarns are tucked and missed along the plated course in such a way 0 that at least one of the at least two or three laid-in yarns is tucked whilst at least one of the at least two or three laid-in yarns is missed along a same wale to form crossover points between at most two consecutive wales.

20 Claims, 3 Drawing Sheets

(58) Field of Classification Search
CPC . D04B 1/265; D04B 7/32; D04B 9/34; D04B 9/52; D04B 9/56
USPC ..... 66/61, 172 R, 172 E, 178 R, 182
See application file for complete search history.

(56) References Cited

U.S. PATENT DOCUMENTS

| | | | | |
|---|---|---|---|---|
| 2,098,303 | A | 11/1937 | Moses | |
| 2,105,301 | A * | 1/1938 | Saftlas | D04B 1/102 66/190 |
| 2,127,780 | A * | 8/1938 | Marshall | D04B 9/54 66/190 |
| 2,836,970 | A | 6/1958 | Deiss et al. | |
| 3,964,277 | A * | 6/1976 | Miles | D04B 1/123 66/190 |
| 4,034,581 | A * | 7/1977 | Swafford | D04B 1/26 66/136 |
| 10,011,926 | B2 * | 7/2018 | Gaither | D04B 1/26 |
| 10,689,785 | B2 * | 6/2020 | Buchschuster | D04B 1/18 |
| 2002/0108405 | A1 * | 8/2002 | Yakopson | A61F 13/08 66/177 |
| 2018/0347082 | A1 | 12/2018 | Buchschuster et al. | |
| 2022/0151341 | A1 * | 5/2022 | Filipescu | A43B 1/04 |

* cited by examiner

Plain stitch
Tuck stitch
Miss stitch
Laid-in yarn 1
Laid-in yarn 2
Ground yarn
Plating yarn Laid-in yarn 1
Laid-in yarn 2
Ground yarn
Plating yarn Laid-in yarn 1
Laid-in yarn 2
Laid-in yarn 3
Ground yarn
Plating yarn Laid-in yarn 1
Laid-in yarn 2
Ground yarn
Plating yarn Laid-in yarn 1
Laid-in yarn 2
High-friction yarn
Ground yarn
Plating yarn

COMPRESSION ARTICLE WITH A PLATING YARN

CROSS-REFERENCE TO RELATED APPLICATIONS

This application is the national stage entry of Patent Cooperation Treaty Application No. PCT/EP2023/059496, filed Apr. 12, 2023, titled "TUBULAR WEFT KNITTED JERSEY-BASED FABRIC, COMPRESSION ARTICLE COMPRESSING SAID FABRIC AND A METHOD FOR PRODUCING IST PRODUCTION." the entire contents of which are hereby incorporated herein by reference.

TECHNICAL FIELD

The invention relates to a tubular weft-knitted jersey-based fabric having a ground knit consisting of plain stitches over at least 60% of the circumference of the tubular weft-knitted jersey-based fabric. The fabric comprises a portion of the size of at least four consecutive courses and at least four consecutive wales. All of the at least four courses are plated courses. Each plated course comprises a ground yarn that entirely forms plain stitches, two or three laid-in yarns and a plating yarn.

Furthermore, the invention relates to a method for producing such a tubular weft-knitted jersey-based fabric on a single jersey circular knitting machine, having at least three feeds.

BACKGROUND ART

Tubular weft-knitted jersey-based fabric produced on a single jersey circular knitting machine are used to produce compression articles. These compression articles can range from compression socks, compression thigh-high stockings, compression pantyhose to compression sleeves and have the particularity to have an elastic non-knitted yarn laid in the ground jersey structure to control the course-wise elasticity. As the diameter of the single jersey circular knitting machine and its number of needles are fixed on these single jersey circular knitting machines, the diameter of the compression article is controlled by altering the tension of the laid-in yarn and to a lesser extent by varying the stitch length.

The laid-in yarn thus plays an important role in controlling the pressure throughout the compression articles.

To hold the laid-in yarn in the technical back of the knit of the articles, the laid-in yarn is inserted into the ground on a tuck-and-miss basis in course-wise direction. The most common structure in medical compression articles comprises laid-in yarns incorporated on a 1×1 tuck-and-miss basis.

In compression articles, the ground yarn typically forms predominantly or entirely plain stitches in order to maximize the stretchability of the ground knit.

Plating is a knitting technique used to change the physical appearance or technical properties of the knit and in particular to create an aesthetic design. The technique involves separately supplying through its own guide two (or more) yarns to the needle hook and influencing the respective position of the two (or more) yarns relative to the technical front of the knit. As described in the norm ISO 8388:1998, when the plating yarn is knit, it appears on the technical front of the fabric whilst the ground knit appears on the technical back. When the plating yarn is not knit, it appears on the technical back of the fabric, making the ground yarn visible on the technical front of the fabric. Plating on all the needles is preferred in order to avoid hindering the stretchability of the knit.

The ability to plate on any needles is key to be able to create a detailed aesthetic design and to maximize the stretchability of the knit.

However, the known means do not enable to plate on any needle on a single jersey circular knitting machine without creating defects in the plating (called "miss-plating"). In compression articles, the insertion of the laid-in yarn moves part of the needles forward and part of the needles backward. In the case of 1×1 inlaid stitches, the odd and the even needles are placed to the front and the back respectively. As a consequence, only half of the needles—either the odd needles or the even needles (never simultaneously)—are available for plating. Thus, the dealignment of the needles caused by the insertion of the laid-in yarn makes it impossible to plate on any needle without creating miss-plating on circular knitted compression articles.

DISCLOSURE OF THE INVENTION

The problem to be solved by the present invention is therefore to provide a tubular weft-knitted jersey-based fabric with a plating yarn having a detailed design where miss-plating is reduced or avoided.

This problem is solved by a tubular weft-knitted jersey-based fabric according to the independent device claim. The jersey-based ground knit consists of plain stitches over at least 60% of the circumference of the tubular weft-knitted jersey-based fabric and comprises a portion of the size of at least four, in particular of at least 20, in particular of at least 40, consecutive courses and of at least four, in particular of at least 20, in particular of at least 40, consecutive wales, in particular of all wales of the circumference. All of the at least four courses are plated courses. Each plated course comprises

- a ground yarn that entirely forms plain stitches,
- at least two or at least three laid-in yarns, in particular exactly two or exactly three laid-in yarns. The laid-in yarns are tucked and missed along the plated course in such a way that at least one of the at least two or three laid-in yarns is tucked whilst at least one of the at least two or three laid-in yarns is missed along a same wale to form crossover points between at most two consecutive wales. In the case of two laid-in yarns, the second laid-in yarn is missed on the wales on which the first laid-in yarn is tucked and is tucked on the wales on which the first laid-in yarn is missed in such a way that the two laid-in yarns cross one another to form crossover points between at most two consecutive wales. The knit structure comprises most adequately exactly two laid-in yarns.
- a plating yarn.

The defined structure enables to align all the needles and to make all the needles available for plating and consequently to plate on all needles. Miss-plating can be avoided. This technique enables to knit a detailed aesthetic design and to maximize the stretchability of the knit.

The invention is defined by a portion of at least four courses and at least four wales. A "course" is a horizontal row of stitches produced by adjacent needles during the same knitting cycle. A "wale" is a vertical column of intermeshed needle loops generally produced by the same needle knitting at consecutive knitting cycles.

A "jersey-based fabric" refers to a fabric having predominantly plain jersey stitches in the ground knit. In particular, the ground knit consists of plain stitches over at least 60% of the circumference of the tubular weft-knitted jersey-based fabric.

"Laid-in yarns" are non-knitted yarns that are incorporated into the ground knit on a tuck-and-miss basis. As such, the laid-in yarns necessarily reside predominantly on the technical back of the fabric.

"Crossover points" correspond to intersection points where the two laid-in yarns cross meet and go across each other.

A "plated yarn" corresponds to a yarn added to the ground yarn to form together a plated structure containing loops of these two yarns. In particular, each yarn is separately supplied through its own guide to the needle hook, in order to influence its respective position relative to the technical front of the knit. The yarns are positioned in the needle in such a way that when knit, the plating yarn appears on the technical front of the knit and the ground yarn appears on the technical back of the knit.

It is envisioned that the portion of an article knitted as defined in the claim is significantly larger. However, the invention is realized if the structure is knit according to the invention within a portion with the size as defined.

Preferably, the two or three laid-in yarns have at most 25%, in particular at most 10%, difference in yarn count between themselves, and have at most 25%, in particular 10%, difference in elongation, in particular have the same yarn count and elongation.

Preferably, the plating yarn has mostly the same type of stitch as the ground yarn in order to maximize the knit stretchability.

In preferred embodiments, each of the two or three laid-in yarns is incorporated on a 1×1, 2×1, 1×2 or 2×2 tuck-and-miss basis within the portion.

Preferentially, at least one of the at least two or three laid-in yarns is tucked whilst at least one of the at least two or three laid-in yarns is missed along a same wale to form crossover points between each consecutive wale within the portion.

Preferably, the plated course comprises exactly two laid-in yarns, namely a first and a second laid-in yarn, in particular forming alternatively single tuck stitches and single miss stitches within the portion. As such, they are incorporated on a 1×1 tuck-and-miss basis, as to cross one another to form crossover points between each wale.

Preferentially, the plating yarn and the ground yarn have either different colors or shades or different dyabilities. Depending on the type of stitch of the plating yarn, the plating yarn is either positioned in front or behind the ground yarn. The relative position of the plating yarn to the ground yarn in the knit enables to create zones of different colors or shades that form an aesthetic design on the technical front of the tubular weft-knitted jersey-based fabric. In the case where the plating yarn and the ground yarn have different dyabilities, the dye of the tubular weft-knitted jersey fabric enables to reveal the aesthetic design. Using a plating yarn and a ground yarn of different colors or shades is preferred as it involves one manufacturing step less and does not rely on the dyeability of the knit. As such, preferentially, the tubular weft-knitted jersey-based fabric has one or more zones of the fabric in a first color or shade and one or more zones of the fabric in a second contrasting color or shade on the technical front of the tubular weft-knitted jersey-based fabric such that:

in the zones of the fabric in the first color, the type of stitch of the plating is the same as the type of stitch of the ground yarn, in the zones of the fabric in the second color, the type of stitch of the plating yarn is not the same as the type of the ground yarn.

Advantageously, the portion extends over the whole circumference of the article, and the plating yarn forms the same type of stitch as the ground yarn on at least 60%, in particular on at least 80%, of the whole course. With other words, in more than 60%, in particular in more than 80% of the stitches, the plating yarn does not form a miss stitch.

As already said, the invention enables to align all the needles and to make all the needles available for plating and consequently to plate on all needles. This ability is most noticeable if the plating yarn is knit within the portion as plain stitches on all wales.

The plated portion can also include an additional yarn that is a high-friction yarn on at least one of the at least four plated courses of the portion. The high-friction yarn is An elastic bare silicone yarn, a bare elastane yarn, a bare natural rubber yarn, an elastic yarn coated with silicone or with elastomer, an elastic yarn covered with one covering yarn wherein the covering yarn is a bare silicone, a bare elastane yarn or a bare natural rubber yarn, an elastic yarn covered with two covering yarns wherein the outer of the two covering yarns is a bare silicone, a bare elastane yarn or a bare natural rubber yarn, an elastic yarn covered with one covering yarn wherein the covering yarn is coated with silicone or with elastomer or an elastic yarn covered with two covering yarns wherein the outer of the two covering yarns is coated with silicone or with elastomer.

In particular, on the plated courses comprising the high-friction yarn, the high-friction yarn is floated over at least three consecutive wales, in particular over four to nine consecutive wales, preferentially over exactly seven consecutive wales within the portion. The high-friction floats can enable the plated portion to have a grip to create a grip top band, having a detailed aesthetic design, for instance, on the upper part of a compression thigh-high stocking, of compression knee-high socks or of compression calf-high socks.

A "float" is a portion of yarn that has not been kinked by several needles and that consequently hangs freely over several wales.

The high-friction yarn can be incorporated on a tuck-and-miss basis, on a tuck-and-plain basis or on a plain-and-miss basis. In a preferred embodiment, the high-friction yarn is incorporated on a 1×3, 3×1, 1×4, 4×1, 1×5, 5×1, 1×6, 6×1, 1×7, 7×1, 1×8, 8×1, 1×9 or 9×1 tuck-and-miss basis, on a 1×3, 1×4, 1×5, 1×6, 1×7, 1×8 or 1×9 plain-and-miss basis or on a 3×1, 4×1, 5×1, 6×1, 7×1, 8×1 or 9×1 tuck-and-plain basis, preferentially on a 1×7 or 7×1 tuck-and-miss basis.

When the high-friction yarn is floated and incorporated on a 1×3, 1×4, 1×5, 1×6, 1×7, 1×8 or 1×9 tuck-and-miss basis or on a 1×3, 1×4, 1×5, 1×6, 1×7, 1×8 or 1×9 plain-and-miss basis, the high-friction yarn is not held on the consecutive needles that are in miss position and forms a float. The high-friction yarn is held on the adjacent needle that is in tuck or in plain position where either a tuck stitch or a plain stitch is formed.

When the high-friction yarn is incorporated on a 3×1, 4×1, 5×1, 6×1, 7×1, 8×1 or 9×1 tuck-and-miss basis or on a 3×1, 4×1, 5×1, 6×1, 7×1, 8×1 or 9×1 tuck-and-plain basis, the high-friction yarn is not held on the consecutive needles that are in tuck position. The head on the tuck stitch floats across between the consecutive wales and forms a float. The high-friction yarn is held on the adjacent needle that is in miss or in plain position where either a miss stitch or a plain stitch is formed.

Incorporating the high-friction yarn on a 3×1, 4×1, 5×1, 6×1, 7×1, 8×1 or 9×1 tuck-and-miss basis or on a 3×1, 4×1, 5×1, 6×1, 7×1, 8×1 or 9×1 tuck-and-plain basis is preferred as it enables to create larger floats, with a higher grip.

The invention also relates to an article comprising the tubular weft-knitted jersey-based fabric.

In a preferred embodiment, the article is a compression article, in particular a medical compression garment having a controlled pressure profile along its length. In particular, the controlled pressure profile is formed to apply a compressive force on a body part, for example a leg or an arm. The controlled pressure profile is achieved by controlling the tension of the elastic non-knitted yarn laid-in the ground jersey-based fabric.

In a preferred embodiment, the compression article is a compression sock, a compression thigh-high stocking, a compression pantyhose or a compression sleeve.

However, this invention can be also used on any other types of laid-in tubular weft-knitted jersey-based fabric produced on a single jersey circular knitting machine having at least three feeds.

Another problem to be solved by the present invention is to provide a method for producing a tubular weft-knitted jersey-based fabric with a plating yarn where miss-plating is reduced or avoided. This problem is solved by a method for producing a tubular weft-knitted jersey-based fabric on a single jersey circular knitting machine, having at least three feeds, wherein the tubular fabric comprises a ground knit consisting of plain stitches over at least 60% of the circumference of the tubular weft-knitted jersey-based fabric and a portion of the size of at least four consecutive courses and at least four consecutive wales, wherein all of the at least four courses are plated courses, wherein knitting each plated course within the portion comprises the following actions:

knitting only plain stitches with the ground yarn, inlaying the two or three laid-in yarns, plating the plating yarn, wherein the laid-in yarns are tucked and missed along the plated course in such a way that at least one of the at least two or three laid-in yarns is tucked whilst at least one of the at least two or three laid-in yarns is missed along a same wale to form crossover points between at most two consecutive wales.

Other advantageous embodiments are listed in the dependent claims as well as in the description below.

BRIEF DESCRIPTION OF THE DRAWINGS

The invention will be better understood and objects other than those set forth above will become apparent from the following detailed description thereof. Such description makes reference to the annexed drawings, wherein.

MODES FOR CARRYING OUT THE INVENTION

Figure 1:
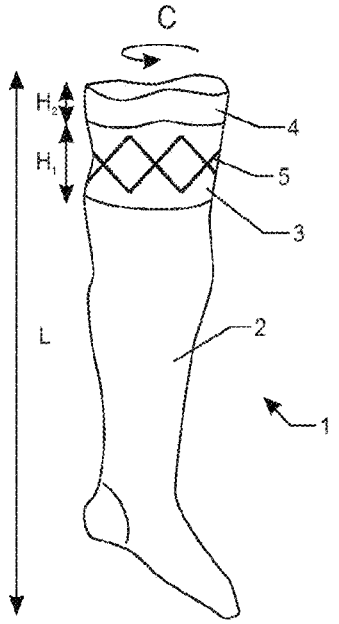
FIG. 1 shows a compression thigh-high stocking with a detailed aesthetic design according to the invention.

FIG. 1 shows a medical compression garment 1 in the form of a compression thigh-high stocking. The compression thigh-high stocking 1 has a controlled pressure profile along its length L. The controlled pressure profile is achieved by controlling the tension of an elastic non-knitted yarn laid in the ground jersey-based fabric.

The compression thigh-high stocking of FIG. 1 comprises a body portion 2 formed as a tubular body, a plated anti-slip portion 3 and a welt 4. The plated antislip portion 3 is integrally formed with the body portion 2 and comprises a detailed aesthetic design 5. The plated anti-slip portion 3 is arranged proximate to the upper end of the compression thigh-high stocking 1 and extends over the whole circumference C of the compression thigh-high stocking 1. The welt 4 is intended to prevent the topmost upper extent of the compression thigh-high stocking 1 from rolling down over on itself and forming an undesirable thicker area.

The compression thigh-high stocking 1 according to FIG. 1 has a Length L of approximately 58 cm and reaches until the middle of the thigh. The plated antislip portion 3 has a high $H_1$ of 6 cm and a circumference C of 39 cm in a non-stretched state. The welt 4 has a high $H_2$ of 2.5 cm.

The compression thigh-high stocking 1 has a tubular weft-knitted jersey-based fabric and can be knitted by any conventional single jersey circular knitting machine having four feeds, for example by a four-feed CC4II Med single jersey circular knitting machine of 30 gauges from Merz.

On most of the plated anti-slip portion 3, the plating yarn is visible on the technical front i.e. on the outside of the compression thigh-high stocking. On most of the plated anti-slip portion 3, the ground yarn is covered by the plating yarn and appears on the technical back, i.e. on the inside of the compression thigh-high stocking 1.

In order to create zones of different colors to form a detailed aesthetic design 5, the plating yarn can either have the same or a different type of stitch as the ground yarn. For instance, the plating yarn can form the same type of stitch as the ground yarn on most of the knit to create a zone of a first color to form the background color. When forming the same type of stitch as the ground yarn, the ground yarn is covered by the plating yarn and the ground yarn appears on the technical front of the fabric. On the zones of the knit of the second constrating color, the plating yarn forms additional miss stitches compared to the ground yarn. When forming miss stitches, the plating yarn is moved to the technical back of the fabric and the ground yarn appears on the technical front of the fabric. For example, if the plating yarn has a red color and the ground yarn has a black color, the plated anti-slip portion 3 is mainly red and the detailed design 5 appearing on the plated anti-slip portion 3 is black.

Figure 2A:
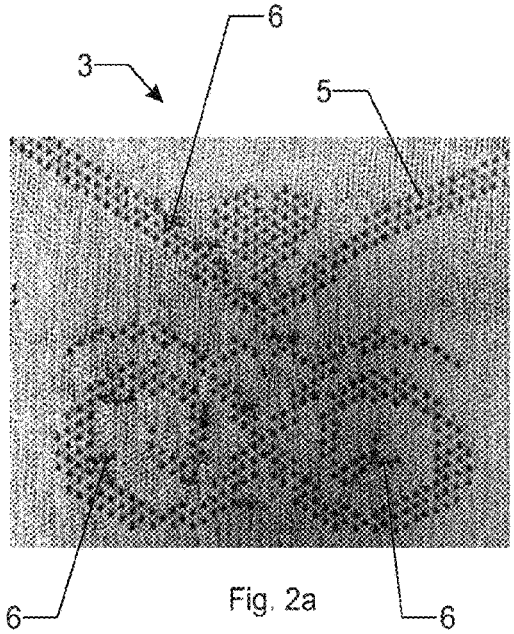
FIG. 2*a* shows a plated portion of a compression thigh-high stocking with a detailed aesthetic design wherein each plated course comprises only one laid-in yarn, creating visible miss-plating on the technical front of the fabric.
Figure 2B:
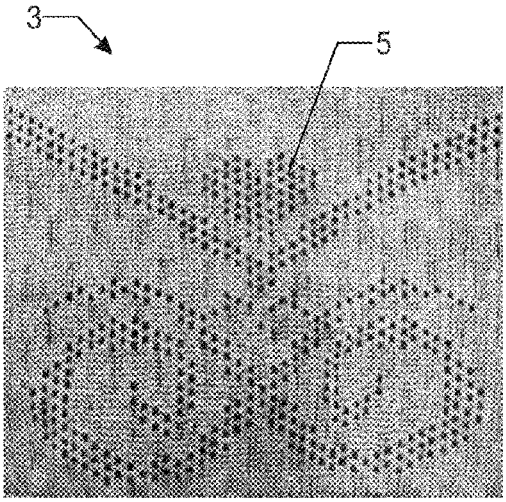
FIG. 2*b* shows a plated portion of the inventive compression thigh-high stocking with a detailed aesthetic design according to FIG. 1 without miss-plating.

FIGS. 2*a* and 2*b* show a plated anti-slip portion 3 of a compression thigh-high stocking with a detailed aesthetic design 5. As just said, the detailed aesthetic design 5 is black, defined by the color of the ground yarn, and the background is red, defined by the plating yarn.

FIG. 2*a* illustrates the case where the plated course comprises only one laid-in yarn, wherein undesired miss-plating are created. When the single laid-in yarn is tucked, the needles taking the laid-in yarn are moved to the back, i.e. the needles are dealigned, and make these back needles unavailable for plating. Visible defects in the plating are created (miss-plating) and a clean detailed aesthetic design cannot be generated. Such missplatings are illustrated in FIG. 2*a* by reference number 6. These miss-platings disturb the appearance of the detailed aesthetic design 5 and should be avoided. Incorporating two laid-in yarns according to the invention avoid such miss-plating and a clean and detailed aesthetic design, as shown in FIG. 2*b*, can be created.

FIGS. 3*a* to 3*e* illustrate the knitting of article fabric according to the invention. The fabric is produced by a conventional single jersey circular knitting machine having at least three feeds. Each of the FIGS. 3*a* to 3*e* show only one single course consisting of several yarns, namely a first laid-in yarn, a second laid-in yarn, a ground yarn and a plating yarn, in FIG. 3*c* additionally a third laid-in yarn and in FIG. 3*e* additionally a high-friction yarn.

The knitting is illustrated by two different types of notation systems which are simple symbolic representations of a knitting repeat sequence. Each horizontal row of squares represents a yarn. The four (FIG. 3*a*, 3*b*, 3*d*) or the five (FIG. 3*c*, 3*e*) yarns represent together one single course with four or five yarns. Courses as shown in FIGS. 3*a* to 3*e* are plated course as defined in the claims.

In the notation system on the left, an empty square represents a miss stitch. A point is placed in the middle of a square where a tuck stitch occurs and an empty circle is placed in the square where a plain stitch occurs.

In the notation system on the right, the points represent a needle in plan view from above and, after the thread path has been drawn, it also represents its stitch.

Any desirable yarn of natural, synthetic or artificial fibers can be used as material for the ground yarn and the plating yarn. The choice of material of the laid-in yarns depends on the type of article, the portion of the article being knit and the single jersey circular knitting machine gauge. In the case of compression thigh-high stockings being knit on a single jersey circular machine of 30 gauges, the ground yarn can be a 1/44/34 dtex textured nylon and the plating yarn can be 2/78/23 textured nylon for example.

In terms of yarn count, any yarn count can be used for the ground yarn and the plating yarn. The plating yarns must have a higher yarn count than the ground yarn in order for the plating yarn to cover well the ground yarn.

The materials of the laid-in yarns can be any type of elastic yarns. The choice of material of the laid-in yarns depends on the type of article, the portion of the article being knit and the machine gauge. In the case of knitted grip portion of compression thigh-high stockings produced on a single jersey circular knitting machine of 30 gauges, the laid-in yarns can be 180 denier double covered with 1/22/7 textured nylon yarn for example.

The yarn count of the laid-in yarns is between 40 and 720 denier, preferably between 90 and 360 denier. In case the laid-in yarns are bare elastic yarns, they can have between 400 and 700% of elongation. In case the laid-in yarns are covered elastic yarns, then, they can have between 200 and 450% of elongation.

The two or three laid-in yarns do not have to be of the same elastomer. However, in order to align the needles, the two or three laid-in yarns must have the same or similar yarn count and the same or similar elongation. The two or three laid-in yarns must have at most 25% difference in yarn count between themselves, preferentially at most 10%. They also must have at most 25% difference in elongation, preferably at most 10%.

In case the plated portion also includes a high-friction yarn, the high-friction yarn is

- an elastic bare silicone yarn,
- a bare elastane yarn,
- a bare natural rubber yarn,
- an elastic yarn coated with silicone or with elastomer,
- an elastic yarn covered with one covering yarn wherein the covering yarn is a bare silicone, a bare elastane yarn or a bare natural rubber yarn,
- an elastic yarn covered with two covering yarns wherein the outer of the two covering yarns is a bare silicone, a bare elastane yarn or a bare natural rubber yarn,
- an elastic yarn covered with one covering yarn wherein the covering yarn is coated with silicone or with elastomer or
- an elastic yarn covered with two covering yarns wherein the outer of the two covering yarns is coated with silicone or with elastomer.

In terms of yarn count, if the high-friction yarn is an elastic bare silicone yarn or a yarn coated with silicone, it can be between 500 and 5000 denier. If the high-friction yarn is a bare elastane yarn or a yarn coated with elastomer, it can be between 120 and 720 denier. If the high-friction yarn is a bare natural rubber yarn or a yarn coated with natural rubber coated yarn, it can be between 300 and 7000 denier.

Figures 3A, 3B, 3C, 3D, 3E:
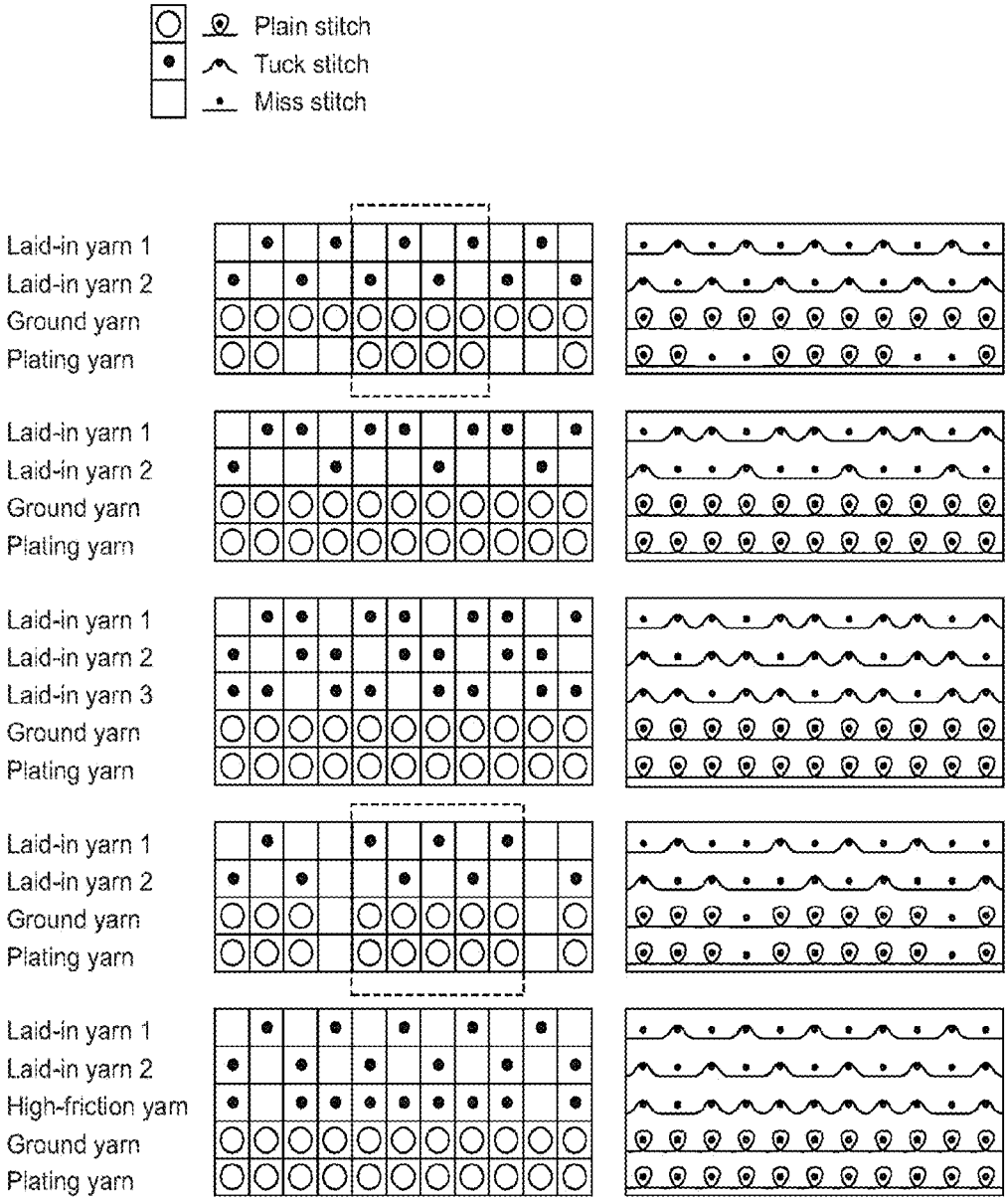
FIG. 3*a* shows the technical back of an exemplary course wherein two laid-in yarns are incorporated on a 1×1 tuck-and-miss basis in a plated jersey-based ground knit, wherein the plating yarn forms miss stitches.
FIG. 3*b* shows the technical back of an exemplary course wherein two laid-in yarns are incorporated on a 1×2 and 2×1 tuck-and-miss basis in a plated jersey-based ground knit, wherein the plating yarn does not form miss stitches.
FIG. 3*c* shows the technical back of an exemplary course wherein three laid-in yarns are incorporated on a 2×1 tuck-and-miss basis in a plated jersey-based ground knit.
FIG. 3*d* shows the technical back of an exemplary course wherein two laid-in yarns are incorporated on a 1×1 tuck-and-miss basis in a plated jersey-based ground knit having miss stitches.
FIG. 3*e* shows the technical back of an exemplary course wherein two laid-in yarns are incorporated on a 1×1 tuck-and-miss basis in a plated ground knit with a floated high-friction yarn on a 7×1 tuck-and-miss basis.

The portion of the tubular weft-knitted jersey-based fabric according to the invention can be knitted for instance on a three-feed single jersey circular knitting machine according to the following specifications as to produce a knit as illustrated by FIGS. 3*a*, 3*b* and 3*d:*

- $1^{st}$ Feed-Finger 1: (plating yarn) 2/78/23 textured nylon
- $1^{st}$ Feed-Finger 8: (ground yarn) 1/44/34 textured nylon
- $2^{nd}$ Feed-Finger 8: (laid-in yarn 1) 180 denier double covered with 1/22/7 textured nylon yarn
- $3^{rd}$ Feed-Finger 7: (laid-in yarn 2) 180 denier double covered with 1/22/7 textured nylon yarn Alternatively, the portion of the tubular weft-knitted jersey-based fabric according to the invention can be knitted for instance on a four-feed single jersey circular knitting machine according to the following specifications as to produce a knit as illustrated by FIGS. 3*a*, 3*b* and 3*d:*

- $1^{st}$ Feed-Finger 1: (plating yarn) 2/78/23 textured nylon
- $1^{st}$ Feed-Finger 8: (ground yarn) 1/44/34 textured nylon
- $2^{nd}$ Feed-Finger 1: (plating yarn) 2/78/23 textured nylon
- $2^{nd}$ Feed-Finger 8: (ground yarn) 1/44/34 textured nylon
- $3^{rd}$ Feed-Finger 8: (laid-in yarn 1) 180 denier double covered with 1/22/7 textured nylon yarn
- $4^{th}$ Feed-Finger 7: (laid-in yarn 2) 180 denier double covered with 1/22/7 textured nylon yarn Regarding the knit illustrated by FIG. 3*c*, it can be knitted for instance on a four-feed single jersey circular knitting machine according to the following specifications:

1st Feed-Finger 1: (plating yarn) 2/78/23 textured nylon
1st Feed-Finger 8: (ground yarn) 1/44/34 textured nylon
2nd Feed-Finger 8: (laid-in yarn 1) 180 denier double covered with 1/22/7 textured nylon yarn
3rd Feed-Finger 7: (laid-in yarn 2) 180 denier double covered with 1/22/7 textured nylon yarn
4th Feed-Finger 8: (laid-in yarn 3) 180 denier double covered with 1/22/7 textured nylon yarn Regarding the knit illustrated by FIG. 3*e*, it can be knitted for instance on a four-feed single jersey circular knitting machine according to the following specifications:

1rst Feed-Finger 3: (high-friction yarn) Silicone Yarn 1000 dtex
2nd Feed-Finger 1: (plating yarn) 2/78/23 textured nylon
2nd Feed-Finger 8: (ground yarn) 1/44/34 textured nylon
3rd Feed-Finger 8: (laid-in yarn 1) 180 denier double covered with 1/22/7 textured nylon yarn
4th Feed-Finger 7: (laid-in yarn 2) 180 denier double covered with 1/22/7 textured nylon yarn As already said, the invention relates to a tubular weft-knitted jersey-based fabric having a portion of the size of at least four consecutive courses and at least four consecutive wales wherein all of these courses are plated courses. Each plated course comprises a ground yarn that entirely forms plain stitches, two or three laid-in yarns and a plating yarn. The laid-in yarns are tucked and missed along the plating course in such a way that at least one of the at least two or three laid-in yarns is tucked whilst at least one of the at least two or three laid-in yarns is missed to form crossover points between at most two consecutive wales. Miss-plating can be avoided.

Figure 4:
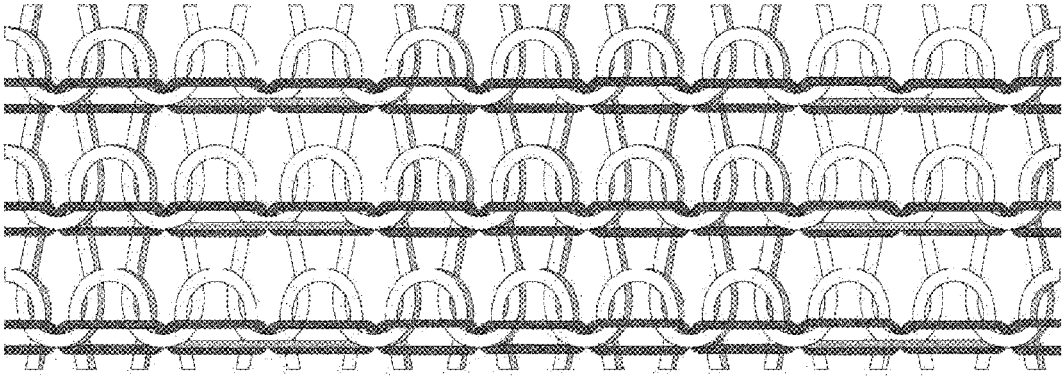
FIG. 4 shows the technical back of a knit formed by three consecutive courses of FIG. 3*a*.

Regarding FIG. 3*a* and FIG. 4: the tubular weft-knitted jersey-based structure comprises a first and a second laid-in yarn, a ground yarn and a plating yarn along the same course. The first and second laid-in yarns are incorporated on a 1×1 tuck-and-miss basis in a ground knit but shifted relative to each other by one stitch in such a way that the first laid-in yarn is tucked whilst the second laid-in yarn is missed along a same wale. The first and the second laid-in yarns form alternatively single tuck stitches and single miss stitches. The laid-in yarns cross one another to form crossover points between each wale.

The plating yarn is mainly knit as plain stitches but forms miss stitches on the third, fourth, ninth and tenth wales. Such miss stitches are intended to generate a detailed aesthetic design 5 as shown in FIG. 2*b*. The portion highlighted by the dashed square comprises four wales and the plating yarn is knit within the portion as plain stitches on all wales. The plating yarn appears on the technical front where it is knit as plain stitch.

Regarding FIG. 3*b*: in this case, the first laid-in yarn is incorporated on a 2×1 tuck-and-miss basis and the second laid-in yarn is incorporated on a 1×2 tuck-and-miss basis in such a way that the two laid-in yarns cross one another to form crossover points only before and after every miss stitch of the first laid-in yarn but at most two consecutive wales. The plating yarn is knit as plain stitches on all wales.

Regarding FIG. 3*c*: The single course comprises three laid-in yarns, one ground yarn and one plating yarn. All three laid-in yarns are incorporated on a 2×1 tuck-and-miss basis but shifted relative to each other by one stitch in such a way that on each wale only one laid-in yarn is missed and the two other laid-in yarns are tucked. At least two of the three laid-in yarns cross one another to form crossover points between each wale. The plating yarn is knit as plain stitches on all wales.

Regarding FIG. 3*d*: The course comprises two laid-in yarns, one ground yarn and one plating yarn. The plated ground knit consists of predominently plain stitches and has two miss stitches on the fourth and the tenth column. The portion of five wales between the fifth and the ninth column, highlighted by the dashed square, comprise a ground yarn that entirely forms plain stitches. This portion highlighted by the dashed square also comprise two laid-in yarns incorporated on a 1×1 tuck-and-miss basis to form crossover points between each wale.

Regarding FIG. 3*e*: The course comprises two laid-in yarns, a high-friction yarn, a ground yarn and a plating yarn. Both laid-in yarns are incorporated on a 1×1 tuck-and-miss basis in such a way that the two laid-in yarns cross one another to form crossover points between each wale. The high-friction yarn is incorporated on a 7×1 tuck-and-miss basis and consequently forms floats over seven wales on the technical back of the article. The high-friction yarn is held by the crossover points of the laid-in yarns where a miss stitch and a tuck stitch of the high-friction yarn are adjacent. Both the ground yarn and the plating yarn are knit as plain stitches on all wales.

While the invention is described here for purposes of illustration as a compression thigh-high stocking with a controlled pressure profile, the invention also includes any other garments, such as compression socks, compression pantyhose, compression sleeves, and the like.

The invention claimed is:

1. A tubular weft-knitted jersey-based fabric having a ground knit consisting of plain stitches over at least 60% of the circumference of the tubular weft-knitted jersey-based fabric and having a portion of the size of at least four consecutive courses and at least four consecutive wales, wherein all of the at least four courses are plated courses, wherein each plated course comprises a ground yarn that entirely forms plain stitches,
two or three laid-in yarns,
a plating yarn, and
the laid-in yarns are tucked and missed along the plated courses in such a way that at least one of the at least two or three laid-in yarns is tucked whilst at least one of the at least two or three laid-in yarns is missed along a same wale to form crossover points between at most two consecutive wales.

2. The tubular weft-knitted jersey-based fabric according to claim 1, wherein the two or three laid-in yarns have at most 25% difference in yarn count between themselves, and have at most 25% difference in elongation.

3. The tubular weft-knitted jersey-based fabric according to claim 1, wherein the two or three laid-in yarns are incorporated on a 1×1, 2×1, 1×2 or 2×2 tuck-and-miss basis within the portion.

4. The tubular weft-knitted jersey-based fabric according to claim 1, wherein at least one of the at least two or three laid-in yarns is tucked whilst at least one of the at least two or three laid-in yarns is missed along a same wale to form crossover points between each consecutive wale within the portion.

5. The tubular weft-knitted jersey-based fabric according to claim 1, wherein each plated course of the portion comprises exactly two of the laid-in yarns, namely a first laid-in yarn and a second laid-in yarn, characterized in that the first and the second laid-in yarns are tucked and missed in such a way that the first laid-in yarn is tucked whilst the second laid-in yarn is missed along a same wale to form crossover points between at most two consecutive wales within the portion.

6. The tubular weft-knitted jersey-based fabric according to claim 5, wherein the first and the second laid-in yarns form alternatively single tuck stitches and single miss stitches within the portion.

7. The tubular weft-knitted jersey-based fabric according to claim 1, wherein the ground yarn and the plating yarn have different colors, shades or dyabilities.

8. The tubular weft-knitted jersey-based fabric according to claim 7, having one or more zones of the fabric in a first color or shade and one or more zones of the fabric in a second contrasting color or shade on the technical front of the tubular weft-knitted jersey-based fabric such that in the zones of the fabric in the first color or shade, the type of stitch of the plating yarn is always the same as the type of stitch of the ground yarn, in the zones of the fabric in the second contrasting color or shade, the type of stitch of the plating yarn is always not the same as the type of stitch of the ground yarn.

9. The tubular weft-knitted jersey-based fabric according to claim 1, wherein the portion extends over the whole circumference of the article, and the plating yarn has the same type of stitch as the ground yarn on at least 60% of the whole course.

10. The tubular weft-knitted jersey-based fabric according to claim 1, wherein the plating yarn is knit within the portion as plain stitches on all wales.

11. The tubular weft-knitted jersey-based fabric according to claim 1, wherein at least one of the at least four courses of the portion comprises a high-friction yarn.

12. The tubular weft-knitted jersey-based fabric according to claim 11, wherein the high-friction yarn is an elastic bare silicone yarn, a bare elastane yarn, a bare natural rubber yarn, an elastic yarn coated with silicone or with elastomer, an elastic yarn covered with one covering yarn wherein the covering yarn is a bare silicone, a bare elastane yarn or a bare natural rubber yarn, an elastic yarn covered with two covering yarns wherein the outer of the two covering yarns is a bare silicone, a bare elastane yarn or a bare natural rubber yarn, an elastic yarn covered with one covering yarn wherein the covering yarn is coated with silicone or with elastomer or an elastic yarn covered with two covering yarns wherein the outer of the two covering yarns is coated with silicone or with elastomer.

13. The tubular weft-knitted jersey-based fabric according to claim 11, wherein the high-friction yarn is floated over at least three consecutive wales within the portion.

14. The tubular weft-knitted jersey-based fabric according to claim 11, wherein all of the at least four courses comprise a high-friction yarn.

15. An article comprising a tubular weft-knitted jersey-based fabric according to claim 1.

16. The article according to claim 15, wherein the article is a medical compression garment having a controlled pressure profile along its length.

17. The article according to claim 15, wherein the article is a compression sock, a compression thigh-high stocking, a compression pantyhose or a compression sleeve.

18. A method for producing a tubular weft-knitted jersey-based fabric on a single jersey circular knitting machine with at least three feeds, wherein the tubular fabric comprises a ground knit consisting of plain stitches over at least 60% of the circumference of the tubular fabric and a portion of the size of at least four consecutive courses and at least four consecutive wales, wherein all of the at least four courses are plated courses, wherein knit-ting each plated course within the portion comprises the following actions:

knitting only plain stitches with the ground yarn, inlaying the two or three laid-in yarns, plating the plating yarn, wherein the laid-in yarns are tucked and missed along the plated courses in such a way that at least one of the at least two or three laid-in yarns is tucked whilst at least one of the at least two or three laid-in yarns is missed along a same wale to form crossover points between at most two consecutive wales.

19. The method according to claim 18, wherein the two or three laid-in yarns are incorporated on a 1×1, 2×1, 1×2 or 2×2 tuck-and-miss basis within the portion.

20. The method according to claim 18, wherein the plate courses comprise the action of incorporating a high-friction yarn on a 1×3, 3×1, 1×4, 4×1, 1×5, 5×1, 1×6, 6×1, 1×7, 7×1, 1×8, 8×1, 1×9 or 9×1 tuck-and-miss basis, on a 1×3, 1×4, 1×5, 1×6, 1×7, 1×8 or 1×9 plain-and-miss basis or on a on a 3×1, 4×1, 5×1, 6×1, 7×1, 8×1 or 9×1 tuck-and-plain basis.

* * * * *